US005847363A

United States Patent [19]

Debourg et al.

[11] Patent Number: 5,847,363

[45] Date of Patent: Dec. 8, 1998

[54] HAIR REMOVAL WAX DEVICE

[75] Inventors: Jean-Pierre Debourg, Lyons; Daniel Bontoux, Saint-Genis-Laval, both of France

[73] Assignee: SEB S.A., Ecully, France

[21] Appl. No.: 719,556

[22] Filed: Sep. 25, 1996

[30] Foreign Application Priority Data

Oct. 3, 1995 [FR] France ..... 95 11619

[51] Int. Cl.[6] ..... A45D 26/00; F27B 14/18

[52] U.S. Cl. ..... 219/424; 219/386; 219/438; 222/146.5; 222/192; 222/185.1; 141/18; 141/313

[58] Field of Search ..... 219/385, 386, 219/421, 438, 439, 441; 427/258, 442, 443, 434.3; 607/85, 86, 96, 104; 222/146.2, 146.5, 185.1, 518, 192; 141/10, 18, 313, 317; 401/1, 2; 604/310

[56] References Cited

U.S. PATENT DOCUMENTS

| | | | |
|---|---|---|---|
| 1,592,584 | 7/1926 | Viegelmann | 604/310 |
| 1,595,324 | 8/1926 | Van Sant | 604/310 |
| 3,466,131 | 9/1969 | Arcudi | 604/310 |
| 4,465,073 | 8/1984 | Schwob | 401/2 |
| 4,614,859 | 9/1986 | Beckering et al. | 219/441 |
| 4,941,597 | 7/1990 | Lopez et al. | 222/146.5 |
| 5,019,033 | 5/1991 | Geria | 604/310 |
| 5,305,928 | 4/1994 | Verdaguer | 222/192 |
| 5,395,175 | 3/1995 | Bontoux et al. | 401/1 |
| 5,556,468 | 9/1996 | Legrain et al. | 401/1 |
| 5,681,388 | 10/1997 | Legrain et al. | 401/1 |

FOREIGN PATENT DOCUMENTS

| | | |
|---|---|---|
| 1459825 | 10/1966 | France . |
| 2108866 | 5/1972 | France . |
| 2467786 | 4/1981 | France . |
| 2502917 | 10/1982 | France . |
| 2517940 | 6/1983 | France . |

*Primary Examiner*—Teresa J. Walberg
*Assistant Examiner*—J. Pelham
*Attorney, Agent, or Firm*—Young & Thompson

[57] ABSTRACT

A hair removal wax device comprising at least one tank (9) linked to a heating means (11) and a detachable instrument, independent from the tank (9), designed for sampling from the tank (9) a quantity of molten wax, with a means (12) for transferring of a quantity of hair removal wax from the tank (9) to the detachable instrument, where the detachable instrument is a ductile vessel (1) whose inside volume is variable.

15 Claims, 3 Drawing Sheets

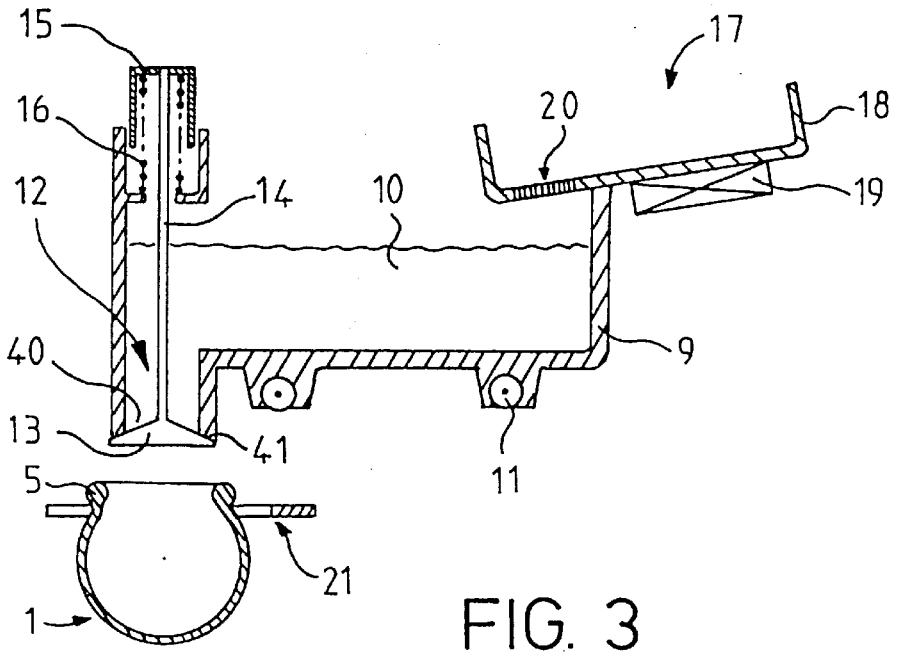
FIG. 3
FIG. 4
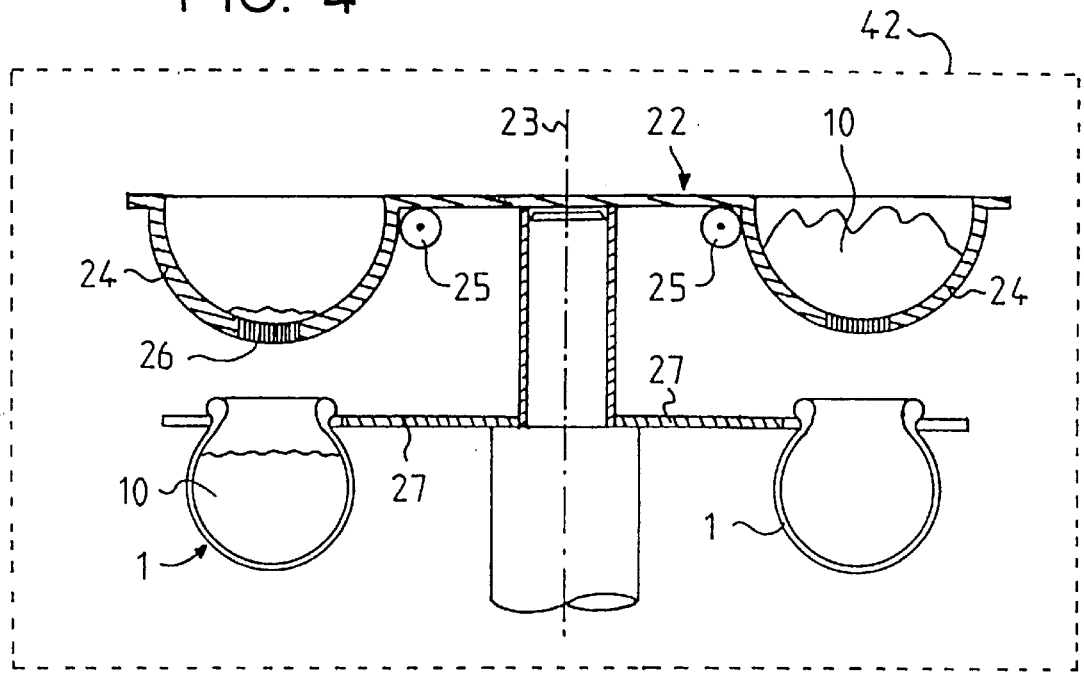

HAIR REMOVAL WAX DEVICE

DESCRIPTION OF THE RELATED ART

This invention relates to the general technical field of application devices of thermofusible produces, such hair removal wax, in which the produce is stored in solid form at room temperature and must be heated in order to change state and take on a condition which is at least pasty, so that it can be applied.

This invention relates more specifically to a hair removal wax device comprising a tank for the produce to be applied, designed to be heated by heating means and a distribution element enabling to apply the said produce.

Whatever the type of hair removal wax applicator considered, the hair removal technique by application of a depilatory wax consists in melting a certain quantity of wax, then in applying the said wax in molten condition onto the zone to be unhaired, in a thin coat. After hardening, at least partial hardening, the wax strip can then be removed. The hairs in the zone in question are then extracted from the skin by sticking to the wax.

For the implementation of this widespread technique, the hair removal wax devices thus generally comprise a vessel designed for containing a volume of hair removal wax. This vessel is linked to heating means enabling to melt the said wax. Most often, when the whole quantity of wax contained inside the vessel has molten, the user inserts a spatula into the molten wax in order to sample a portion that she applies rapidly onto the zone to be unhaired.

These devices are advantageously simple and enable the use of any kind of wax, however, their handling remains particularly tricky inasmuch as the wax may easily fall and soil the floors during the travel on the spatula. Besides, the warm-up time of this device is long since a large quantity of wax has to be molten before the spatula can be used.

In order to improve these conventional devices, applicators of thermofusible produce, especially hair removal wax, have been developed. They are more specifically described in the applications for European patents EP-A-0.629.366 and EP-A-0.592.340.

These devices comprise generally a casing, in which are stored heating means as well as a tank for the produce to be applied. The tank contains an upper opening linked to a distribution roller enabling, after the fusion of the produce contained in the tank, the application of the said produce.

These devices, which are particularly compact, enable good handiness, limit the risks of soiling and facilitate the implementation of the hair removal wax technique. In spite of their being quite convenient, these devices require a waiting time before operation, so that the wax contained in the tank can be molten thoroughly and reach the distribution roller. On the other hand, homogeneous wax coating requires even fusion of the wax over the whole width of the tank. Moreover these devices are single-block units of small dimension, which limits the wax reserve and leads to topping up the tank during the application, which calls for more dead times.

Although such devices are acknowledged as quite convenient for commercial usage of a small quantity of wax, it has appeared well-advised to develop different devices, especially for hair removal on relatively large zones.

Besides, an application for a French patent FR-A-2.517.940 bears upon a device separating the fusion of the wax from its distribution. With the device considered, the distribution element is portable and connected to the tank containing the hair removal wax by a flexible hose. A pump enables to bring the wax to circulate from the tank towards the hose, then towards the distribution element.

Such a device can exhibit a great autonomy. However, one of its shortcomings is that one must wait for the whole quantity of wax contained in the tank to be molten before using it, which causes a relatively long waiting time. Moreover, as with self-contained applicators, the wax has to be adjusted in relation to the characteristics of the application roller and to the various ducts through which the wax flows, which limits the choice of the type of wax that can be used.

SUMMARY OF THE INVENTION

The purpose of the invention is a device enabling to use any sort of hair removal wax, ensuring its own implementation of the hair removal wax process, thus limiting the risks of soiling as well as untimely spreading, while showing great autonomy.

Another purpose of the invention is to have a device whose preparation time before implementation can be particularly limited.

Another purpose of the invention is also to provide the user with easy handling, enabling to master the thickness of the strip to apply, as well as to facilitate the tearing up of the cooled down strip.

To meet these requirements, the invention relates to a hair removal wax comprising at least one tank, designed for containing the hair removal wax, heating means to melt the said hair removal wax contained in the tank and a detachable instrument, independent from the tank, designed to sample a certain quantity of molten wax from the tank.

According to the invention, the hair removal wax comprises transfer means of a quantity of hair removal wax, from the tank to the detachable instrument, and the detachable instrument is a ductile vessel whose inside volume is variable.

This device enables the lady user to manoeuvre the molten hair removal wax inside the internal volume of the detachable instrument, which limits the risks of wasting wax and of soiling the floors or the environment during the travel of the wax from the tank to the zone to be unhaired. On the other hand, the variable geometry vessel enables the user to apply the wax onto the zone to be unhaired while forming an even strip. After cooling down, this evenness and a particular use of the vessel facilitate the tearing up operation.

According to specific embodiments, the invention comprises the following characteristics, considered individually or in all their technically possible combinations:

- the vessel is a flexible matter, preferably made of an elastomer material,
- the inside volume of a vessel leads to a single, circular opening,
- the inside volume of the vessel leads to a padded opening,
- the ductile vessel has, at rest, more or less the form of an open sphere,
- heating means are arranged in the vicinity of the transfer means,
- the transfer means comprise a distribution valve or flap, maintained in closed position by the action of a spring,
- they comprise a re-melting platform designed for the recycling of the strips,
- the platform is fitted with a filtering zone,
- the tank, designed for containing a volume of hair removal wax, is constituted of a rotary plate fitted with cells.

BRIEF DESCRIPTION OF THE DRAWINGS

Various other characteristics and advantages of the invention will be underlined by the following description, given for exemplification purposes and without any limiting nature, in relation with the appended drawings on which:

FIG. 3 represents a schematic section of a first embodiment of the hair removal wax device complying with the invention.

FIG. 4 represents the schematic section of a second embodiment of a hair removal wax device complying with the invention.

DESCRIPTION OF THE PREFERRED EMBODIMENTS

Figure 1:
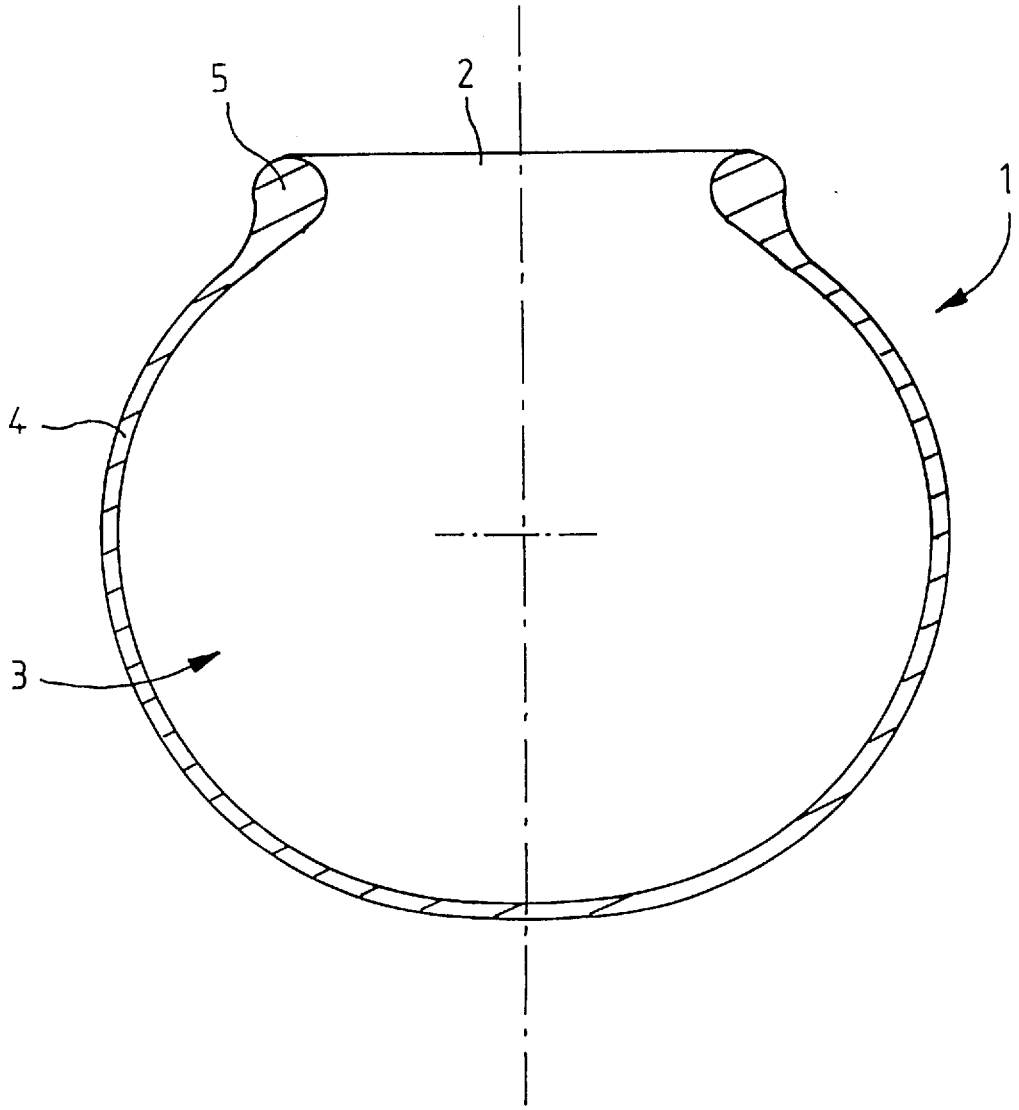
FIG. 1 represents a cross section of an embodiment of a ductile vessel making up the detachable instrument.

The detachable vessel 1 represented more specifically on FIG. 1 comprises an opening 2 enabling the insertion of the hair removal wax, designed for the construction of a strip, in the inside volume 3 of the vessel 1. It is also by this opening 2 that the hair removal wax flows away during the application of the liquid wax in order to build the strip. This opening 2 is fitted with a padding 5 enabling on the one hand to strengthen or to stiffen the opening 2 and, on the other, serving as lips to facilitate the spreading of the hair removal wax during the construction of the strip. The round shape of this padding 5 also enables the user to avoid any attack or risk of wounding for the user's skin, when operating the vessel 1.

This padding 5 lies in the alignment of the walls 4 hugging the inside volume 3. Advantageously, the walls 4 are made of a flexible elastomer material, for instance rubber or latex.

These flexible walls 4 thus confer variable geometry enabling to vary the inside volume 3 of the vessel 1. A pressure exerted on the walls 4 thus enables the user to drive away the molten wax contained inside the vessel 1 when applying the strip.

The vessel 1 is more or less spherical in shape. More precisely, this shape of the vessel, at rest, is a truncated sphere since with respect to a complete sphere, a spherical cap is missing. This truncation constitutes the opening of the vessel. The capacity of the inside volume 3 must be sufficient to contain a quantity of wax necessary to the application of a hair removal strip. Advantageously, this sphere has a diameter ranging between 25 and 45 mm, for instance approximately 35 mm.

The opening 2 is more or less circular and with an inside diameter ranging between 15 and 35 mm, for instance approximately 25 mm.

Figure 2A:
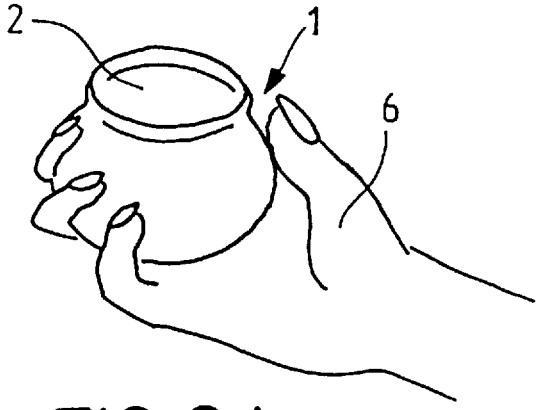
FIGS. 2A, 2B and 2C represent the various phases of the construction of a strip using the detachable instrument.
Figure 2B:
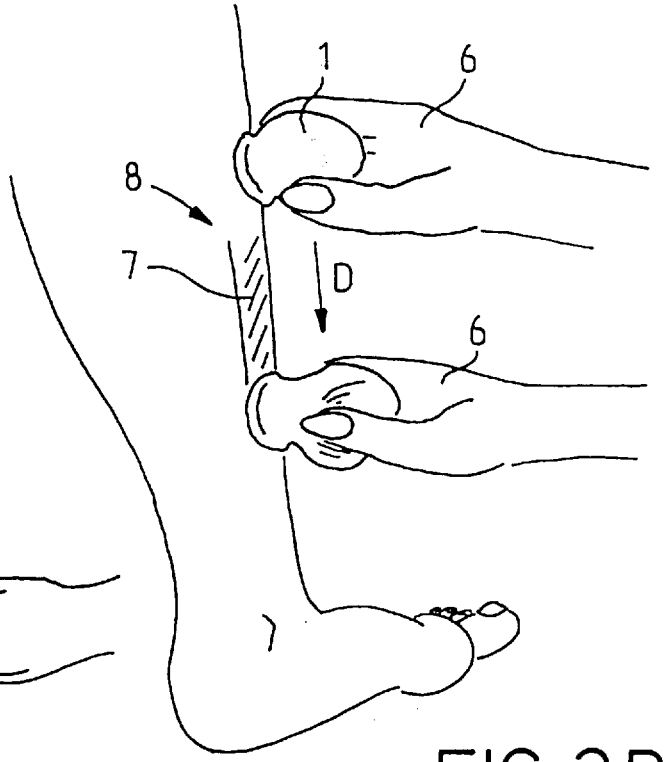
Figure 2C:
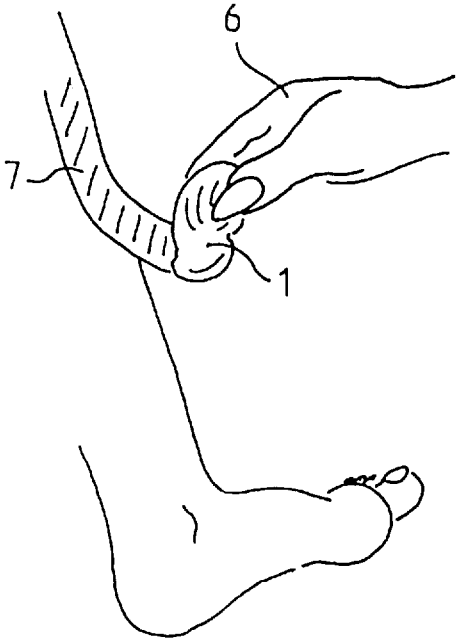

FIGS. 2A, 2B and 2C represent the various operation phases of the vessel 1 during the application of a strip 7 designed to remove the hairs of a given zone 8.

In a first stage, represented on FIG. 2A, a quantity of molten wax sufficient for the application of a strip 7 is inserted inside the vessel 1. The user seizes the vessel 1 by the hand 6, whereas the opening 2 is oriented upwards. The fact that the molten wax is contained inside a volume facilitates the handling while avoiding to soil the environment. The shape of a truncated sphere given to the vessel, at rest, is particularly advantageous.

In a second stage, after displacement close to the zone to be unhaired, as represented on FIG. 2*b*, the vessel 1 is oriented so that its opening comes in contact with the zone 8 to be unhaired of the user's skin. Simultaneously, the vessel 1 is subject to a displacement D along the zone to be unhaired 8 and its walls 4 undergo a slight compression so that the wax is extruded from the vessel 1 and applied regularly onto the skin in order to build a hair removal strip 7.

During the third stage, the solidification and/or cooling down stage of the wax, which is generally short, the vessel 1 can be left in position at the end of the applied strip 7.

The wax strip 7 can then be torn off by an action exerted on the vessel 1, as represented on FIG. 2C. Indeed, the vessel 1 having been left in place on the strip 7 during the solidification stage, it has remained, via the wax contained in the inside volume 3, connected to one of the ends of the strip 7. The extraction of the strip 7 is thus made particularly easy. Thanks to the device according to the invention, it is thus not necessary to lift the beginning of the strip in order to tear it off. The tearing off of the strip 7 removes the hairs and the downs trapped in the wax and guarantees an efficient hair removal operation. Lifting an end of the strip, which is generally very difficult, becomes thus extremely easy.

The vessel 1 may then be disconnected readily from the solid wax strip 7, on the one hand because of the sufficient size of its opening 2 and on the other because of the flexible structure of its walls 4. The latter facilitate the separation of the wax contained inside the vessel. To this view, it is finally possible to fold the walls 4 of the vessel 1 over itself, so that the inner walls appear at the outside of the vessel 1, which makes the emptying and cleaning operations of the vessel 1 still easier.

The solid wax strip can then either be recycled immediately or stored in view of a later recycling or still, disposed of.

A first embodiment of a hair removal device according to the invention is represented more particularly on FIG. 3. This device comprises a tank 9 or vessel designed for containing a volume of hair removal wax 10. This tank 9 is in contact with heating means 11. Advantageously, the tank 9 is made of a good heat conducting material, for example metal and more precisely aluminium. The heating means 11 melts the hair removal wax 10 contained in the tank 9.

Advantageously, this hair removal device comprises the temperature control means, with notably a sensor enabling to stabilise the temperature of the hair removal wax bath 10. These control means maintains the wax bath 10 at the wax operation temperature or at slightly higher a temperature. This temperature can be for instance of approximately 80° C. in the case of conventional wax. The hair removal device may also comprise means to adjust this temperature. The adjustment can be performed by the user in order to take into account the nature of the wax used, the application temperature desired and the slight temperature drop during the transfer.

Transfer means 12 enables transferring a quantity of molten wax from the tank 9 to the detachable vessel 1. These control means 12 are partially integrated to the body of the tank 9. They comprise a valve 13 or flap designed for blanking off, in closed position, an outlet opening 40 for the wax, arranged in the bottom of the tank 9. This valve 13 can be maintained in closed position by a spring 16. The valve 13 is linked to a push-button 15 via a rod 14 or valve spindle. During the transfer or during the loading of the vessel 1, the user presses the push-button 15, this action compresses the spring 16 and releases the valve 13 from its seat 41 arranged in the body of the tank 9. The purpose of this action is to release an opening 40 enabling the wax 10 contained inside the tank 9 to flow freely from the inside of the tank to the inside of the vessel 1. When the vessel 1 contains a sufficient quantity of molten wax, the user releases the push-button 15, the valve 13 returns to closed position by the action of the spring 16 and closes the opening 40 again. The wax stops flowing and the transfer operation is thus complete.

Advantageously heating means 11 are placed close to the transfer means. This arrangement enables to melt very rapidly a sufficient quantity of hair removal wax to carry out the transfer operation and enabling the user to apply a strip. The transfer or the filling operation of the vessel 1 can thus be performed rapidly without waiting for the whole volume of wax 10 contained inside the tank 9 to be in molten condition. This arrangement thus enables the implementation of the device at very short notice. All the hair removal wax 10 contained inside the tank will then melt during the later stages of the hair removal session.

Advantageously during the transfer operation, the vessel 1 is maintained in place by a receiving element 21. This receiving element 21 maintains the vessel under transfer means 12. The hair removal wax may flow directly into the vessel 1 without being supported by the user.

This receiving element 21 can be of variable shape. It may notably maintain the vessel 1 via two legs bearing under the collar 5. The vessel 1 may be solely supported by the action exerted on the collar 5, but also lie on its bottom section.

Advantageously, the hair removal wax device also comprises a melting or re-melting platform 17. The latter comprises a receptacle 18, also made of a good heat conducting material and linked to heating means 19.

This platform 17 allows advantageously the re-melting of the wax strip recently torn off. These wax strips are placed in the receptacle 18 in order to be re-molten in view of their recycling. A filtering zone 20 arranged in a low point of the receptacle 18 enables the filtering of the recycled strips. By design, the reference temperature of the platform 17 is set at 140° C. max., which enables the molten wax to be suitably fluid and to flow rapidly in the tank 9 through the filtering zone 20 whereas the hairs, torn off from the zone to be unhaired with the wax strip, are trapped inside the receptacle 18.

The whole hair removal wax device can thus use any sort of wax. The presence of the strip recycling platform 17 allows continuous usage of the hair removal wax and thus provides the device with very high autonomy. The usage of the re-melting platform 17, fitted with a filtering zone 20, allows re-using the hair removal wax in good conditions and thus limits the consumption or the waste of the wax.

A second embodiment of the invention is represented more particularly on FIG. 4.

In this embodiment, the tank, designed for containing a volume of hair removal wax, is essentially constituted of a plate 22 revolving around an axis 23. This plate is fitted with several cells 24 whose internal volume corresponds more or less to the filling volume of the detachable vessels 1. The plate 22 is placed in contact with heating means 25, enabling to melt the hair removal wax 20 contained in the cells 24 or cups. Each cup 24 is fitted with openings 26 through which the hair removal wax 10 can flow. Under each cup 24 can be placed a vessel 1 maintained by a receiving element 27. The molten wax can thus flow directly from the cups 24 into the vessel 1.

The whole device is located inside an enclosure 42, which prevents at least the wax in the vessels 1 from cooling down. This enclosure is fitted with an opening enabling the user to pick up a vessel 1, containing a sufficient quantity of molten wax to apply a strip. Moreover, this opening allows the user to top up the cups 24 with hair removal wax. The torn off strips during the hair removal operation are replaced by the user in a cup 24. The wax melts and flows slowly towards the vessel 1. The hairs removed with the strip are retained inside the cup 24, whereas the opening 26 making up a filtering zone as well. In order to compensate for the wax waste, the user can top up the contents of the cups 24 or renew it, with fresh wax, preferably delivered as granulates.

During the hair removal operation, and after topping up of the cup, the user rotates the plate 22 in order to place the next vessel 1 containing molten wax in front of the opening. The user removes the vessel 1, makes a strip of wax and tears this strip off after cooling down. After having torn off the strip, the vessel 1 is replaced on the receiving element 27 and the wax strip is replaced in the cup 24. The user rotates the plate 22 once again and resumes the hair removal operation.

When the hair removal session is complete, the device is disconnected and the wax sets inside the vessels 1. When starting another operation, the shape of the vessels 1 as well as their constitutive matter enable to empty them very easily since they can be turned upside down, as with a sock, whereas their relative wide opening as well as the walls made of an elastomer material facilitate this process.

In this embodiment, the wax quantities 10 to be molten, contained in each cup 24, are sufficiently small to allow an operation at particularly short notice.

The rotary plate 22 can have a diameter ranging between 14 and 20 cm, for instance approximately 16 and comprise several cells 24 or cups, whose number may range from 4 to 10, for example 6.

With this device, the fusion and the use of any sort of wax are possible, whereby the small quantities at hand reduce the implementation time.

We claim:

1. A hair removal device comprising:

a tank designed for containing a volume of hair removal wax, a heating means for melting said hair removal wax contained in said tank, a detachable instrument, independent from said tank, designed for sampling a quantity of molten wax from said tank, and a transfer means for transferring the quantity of said hair removal wax from said tank to said detachable instrument, wherein said detachable instrument is a ductile vessel whose inside volume is variable, and has an undeformed shape that approximates the shape of a truncated sphere.

2. A hair removal device comprising:

a tank designed for containing a volume of hair removal wax, a heating means for melting said hair removal wax contained in said tank, a detachable instrument, independent from said tank, designed for sampling a quantity of molten wax from said tank, and a transfer means for transferring the quantity of said hair removal wax from said tank to said detachable instrument, wherein said detachable instrument is a ductile vessel whose inside volume is variable, and said tank comprises a rotary plate fitted with plural depressions, each of said depressions being designed for holding a separate volume of hair removal wax.

3. A hair removal device comprising:

a tank designed for containing a volume of hair removal wax, a heating means for melting said hair removal wax contained in said tank, a detachable instrument, independent from said tank, designed for sampling a quantity of molten wax from said tank, a transfer means for transferring the quantity of said hair removal wax from said tank to said detachable instrument, wherein said detachable instrument is a ductile vessel whose inside volume is variable, and the transfer of the quantity of said hair removal wax from said tank to said ductile vessel is achieved via an opening in said ductile vessel, said opening being designed to dispense the wax contained within said ductile vessel onto an area being treated.

4. A hair removal wax device according to claim 3, wherein the ductile vessel (1) is a flexible vessel.

5. A hair removal wax device according to claim 3, wherein the inside volume (3) of the ductile vessel (1) leads only to said opening, said opening being a single, circular opening (2).

6. A hair removal wax device according to claim 3, wherein said opening (2) is fitted with a padding (5).

7. A hair removal wax device according to claim 3, wherein the ductile vessel (1) has, undeformed, approximately the shape of a truncated spheroid.

8. A hair removal wax device according to claim 3, wherein the heating means (11) is arranged close to the transfer means (12).

9. A hair removal wax device according to claim 3, wherein the transfer means (12) comprises at least one of a distribution valve (13) and flap, maintained in closed position by the action of a spring (16).

10. A hair removal wax device according to claim 3, further comprising a remelting platform (17) designed for the recycling of wax strips (7).

11. A hair removal wax device according to claim 10, wherein the remelting platform (17) is fitted with a filtering zone (20).

12. A hair removal wax device according to claim 3, wherein the tank comprises a rotary plate (22) fitted with plural heated depressions (24).

13. The hair removal device of claim 2, wherein said plural depressions are fitted with openings designed to accommodate a flow of said hair removal wax from each of said plural depressions.

14. The hair removal device of claim 2, wherein said ductile vessel communicates with said plural depressions so that hair removal wax contained within one of said plural depressions flows from said one of said plural depressions into said ductile vessel.

15. The hair removal device of claim 1, wherein said ductile vessel contains a single opening designed to be deformed so as to permit said hair removal wax to be dispensed from said ductile vessel in strips.

* * * * *